US007144261B2

(12) United States Patent
Merlet

(10) Patent No.: US 7,144,261 B2
(45) Date of Patent: Dec. 5, 2006

(54) SAFE CONNECTION DEVICE AND CORRESPONDING CONNECTION PLUG

(75) Inventor: Hervé Merlet, Servon sur Vilaine (FR)

(73) Assignee: Canon Europa NV, Amstelveen (NL)

( * ) Notice: Subject to any disclaimer, the term of this patent is extended or adjusted under 35 U.S.C. 154(b) by 0 days.

(21) Appl. No.: 11/126,207

(22) Filed: May 11, 2005

(65) Prior Publication Data

US 2005/0277320 A1 Dec. 15, 2005

(30) Foreign Application Priority Data

May 12, 2004 (FR) ..... 04 05156

(51) Int. Cl.
*H01R 13/44* (2006.01)

(52) U.S. Cl. ..... 439/136; 200/50.29; 439/147; 439/347; 439/676; 439/911

(58) Field of Classification Search ..... 439/676, 439/136, 143, 911, 147, 347; 200/51 R, 200/50.28, 50.29
See application file for complete search history.

(56) References Cited

U.S. PATENT DOCUMENTS

| | | | | |
|---|---|---|---|---|
| 4,326,110 | A * | 4/1982 | Zdanys, Jr. | 200/16 R |
| 4,389,551 | A * | 6/1983 | Deibele et al. | 200/51 R |
| 4,774,399 | A * | 9/1988 | Fujita et al. | 235/441 |
| 4,872,139 | A * | 10/1989 | Okamoto et al. | 365/52 |
| 5,161,988 | A * | 11/1992 | Krupka | 439/136 |
| 5,921,797 | A | 7/1999 | Bass et al. | 439/342 |
| 6,109,959 | A | 8/2000 | Burlinson et al. | 439/536 |
| 6,215,656 | B1 * | 4/2001 | O'Neal et al. | 361/686 |
| 6,361,372 | B1 * | 3/2002 | Chiang | 439/680 |
| 6,530,806 | B1 * | 3/2003 | Nelson | 439/528 |

FOREIGN PATENT DOCUMENTS

| | | |
|---|---|---|
| DE | 1 903 069 | 10/1964 |
| DE | 31 27 246 | 1/1983 |
| GB | 2 355 864 | 5/2001 |
| JP | 2001 118637 | 4/2001 |

* cited by examiner

*Primary Examiner*—Neil Abrams
(74) *Attorney, Agent, or Firm*—Fitzpatrick, Cella, Harper & Scinto

(57) ABSTRACT

A connection device that is capable of receiving a corresponding connection plug comprises a housing, an electronic board connected to at least one cable of a communications network capable of conveying data as well as electrical energy. This device comprises a movable part between the housing and the electronic board comprising conductive elements used to make the link between the electrical contacts of the plug and the electrical contacts of the electronic board, the movable part taking at least two positions, a first position known as a position of insertion or withdrawal of the plug, in which the link for the passage of electrical energy cannot be made, and a second position known as a position of operation in which the inserted plug is held and the link for the passage of electrical energy can be made.

8 Claims, 10 Drawing Sheets

SAFE CONNECTION DEVICE AND CORRESPONDING CONNECTION PLUG

BACKGROUND OF THE INVENTION

Field of the Invention

The present invention relates to a connection device adapted to receiving a corresponding connection plug or jack. The invention can be applied more particularly to a communications network where the devices serve as an interface between an electronic apparatus and the communications network.

The present invention can be applied more particularly to home use.

The electronic apparatus can take a connection plug and, when the plug is inserted into the connection device, it can receive data and electrical energy for its own supply from the communications network.

This transfer of electrical energy through a connection device may raise problems of safety for the user or for a piece of equipment that has the same type of plug but is not adapted to the reception of electrical energy through this plug.

Thus, a connection device that lets through electrical energy, even at low voltage, can prompt shorting and heating phenomena when the user inserts a metal object. As a result, the electronic board of the connection device may be damaged. Furthermore, a connection to an apparatus in which there is no provision for a power supply through the connection plug matching the connection device would cause damage and even the destruction of the electronic interface of the apparatus.

Even when the apparatus is designed to receive a power supply by the connection plug through the connection device, it is possible that abrupt and unexpected connections and disconnections will provoke electrical arc effects since the device receives electrical energy. At the end of a certain period of time, these electrical arcs may damage the contacts between the connection plug and the connection device.

There are connection devices that have a switch. When this switch is in a first position, it can be used to open the connection circuit of the connection device so as to prevent the working of the devices even when a plug is inserted. This feature is described for example in the patent application GB 2355864 where such a switch is designed to prevent unauthorized operations of access to a communications network or a telephone network.

This document does not describe the use of such a device for the transfer of electrical energy. Thus, this system cannot be used to prevent the arc effects mentioned here above when the switch is in an operating position. It does not provide for any system for ensuring the user's safety to the user and only access control is planned.

There also exist systems to protect children from accidents with electrical sockets, preventing a child from inserting, for example, metal elements. In these systems, the connection or insertion of elements is prevented by the insertion of a movable (or detachable) insulating element which may or may not be withdrawn by means of a key before the corresponding plug is connected. This system does not prevent the electrical arc effects mentioned here above and is not provided in a communications network enabling both data exchange and electrical power supply.

The abstract of the Japanese patent application JP2001118637 describes a system for locking an RJ45 type connector inserted into a connection device. After the plug is inserted into the device, a pin gets inserted into the plug so as to hold it in the inserted position. This is planned in order to prevent any abrupt disconnection that might cause data losses. To disconnect this plug from the device, a key is used.

This system indeed prevents abrupt and unexpected disconnection. However, the use of such a device to obtain a flow of electrical energy is not described. Thus, the problems of safety during the insertion of non-matching elements or the problems of damage to the circuits of non-matching apparatuses or to the electronic board of the device are not mentioned at all.

The present invention seeks to resolve the problems due to the presence of electrical energy during the connection or disconnection of an electrical plug that matches or does not match the connection device.

The present invention seeks to avert problems of damage to electronic boards of the connection device or to apparatuses that may be connected to the connection device.

The present invention is aimed at obtaining a connection device that is made safe for the user.

SUMMARY OF THE INVENTION

To this end, the invention proposes a connection device that is capable of receiving a corresponding connection plug and comprises a housing or box (or frame), an electronic board connected to at least one cable of a communications network capable of conveying both data and electrical energy. This device has a movable (or detachable) part between the housing and the electronic board comprising conductive elements used to make an electrical link between the plug and the electronic board. The movable part haves at least two positions, a first position known as a position of insertion or withdrawal of the plug, in which the electrical link cannot be made, and a second position known as a position of operation in which an inserted plug is held and the electrical link can be made.

Thus, the connection device conveys electrical energy only when it is connected to the corresponding plug. The introduction of metal elements into the connection device will not prompt any undesirable effect since, in the position of insertion, the passage of electrical energy is not possible.

Furthermore, since the plug is held by the movable part when it is inserted, it will not be possible to disconnect it unexpectedly. The arc effects therefore cannot take place since the position of insertion or disconnection alone is possible only when the passage of electrical energy does not occur.

In a preferred embodiment, the movable part of the connection device has a third position, known as an idle position, in which the insertion of the connection plug is not possible.

This position is maintained by a pullback force.

Thus, the movable part automatically takes an idle position in which it is not possible to insert either a non-matching connector or another object. This position gives protection against any intrusion that is not adapted to the working of the device.

In a preferred embodiment, the movable part comprises a recess enabling insertion of a plug and a protuberance that comes into contact with a surface of the plug having no electrical contacts so as to maintain it in the inserted position in the device by a pullback force.

Thus, when the connection plug corresponding to the connection device is inserted, it is held in position by a pullback force that prevents any sudden or unintentional disconnection.

The pullback force is preferably obtained by an elastic means provided between the housing and the movable part.

In a particular embodiment, the movable part of the device comprises at least two conductive elements, one enabling a link between the connection plug and the electronic board for data exchange and electrical energy transfer from the network and the other enabling only a data exchange.

Thus, it is possible to provide for two types of operation for the connection device, a first type in which only a data exchange will take place and a second type in which there will also be a transfer of energy.

In this particular embodiment, the movable part preferably comprises a recess enabling insertion of a plug and a protuberance that comes into contact with a surface of matching shape of a connection plug so that when a plug with a matching shape is inserted, the movable part takes the second position.

This device thus designed therefore provides for operation with energy transfer only when a particular plug that matches the device, is inserted. This therefore prevents any damage to an apparatus that has a non-matching plug and is incapable of receiving any electrical energy through this connector.

Preferably, the device is such that, when a connection plug having no surface of matching shape is inserted, the movable part takes a fourth position in which the electrical link is not possible whereas the data exchange link is possible.

This type of configuration therefore enables operation without energy transfer for devices that do not have a matching plug.

In a particular embodiment, the protuberance comprises a rounded surface.

Thus, this rounded shape enables a disconnection of the connector even in its held position should the disconnection force be excessive and liable to damage the connection device.

The invention also relates to a connection plug adapted to being inserted into a connection device according to the invention. On one of its surfaces that comes into contact with the connection device and does not comprise any electrical contacts, this plug comprises a recess adapted to receiving a protuberance.

Preferably, the connection plug is of an RJ 45 type.

The advantages of this connector correspond to the advantages of the device described here above.

Other particular features and advantages of the invention shall appear from the following description.

BRIEF DESCRIPTION OF THE DRAWINGS

In the appended drawings, given by way of non-restrictive examples.

MORE DETAILED DESCRIPTION

Figure 1A:
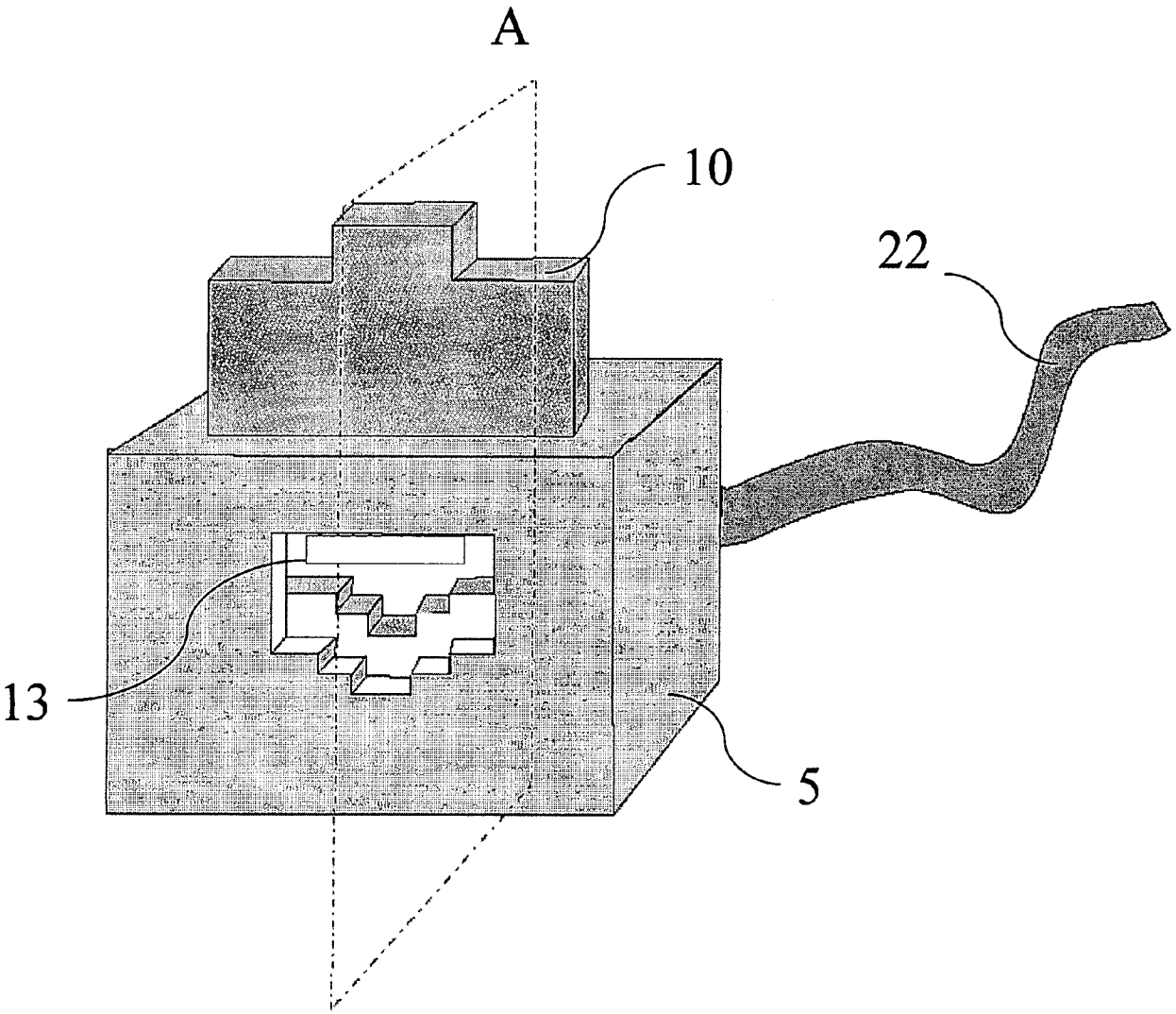
FIGS. 1*a* and 1*b* show schematic views in perspective of a connection device in an idle position and in a position of insertion according to the invention.
Figure 1B:
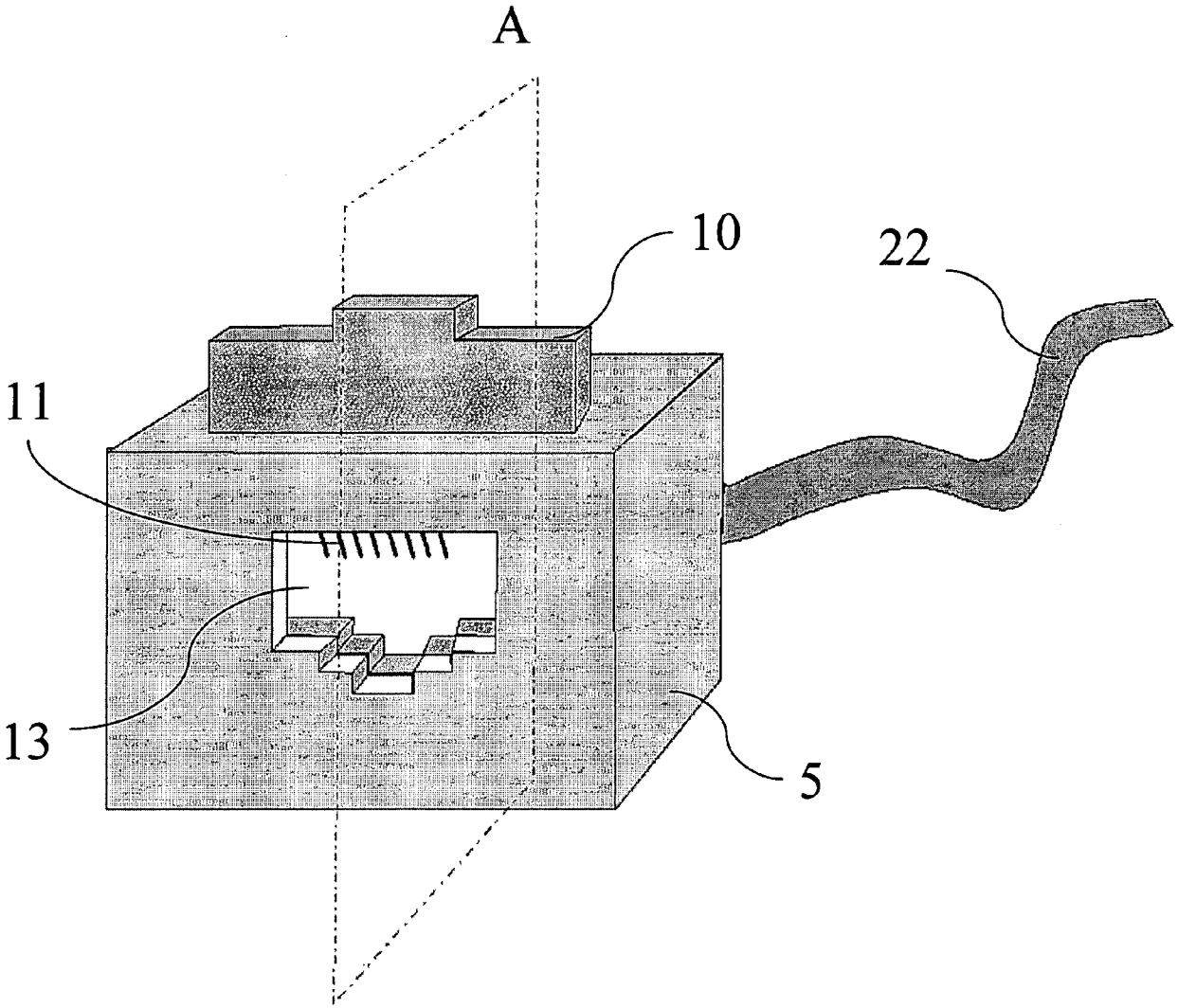

Referring to FIGS. 1*a* and 1*b*, a description shall first of all be given of an RJ45 type connection device. For the sake of simplification, the device has only one type of connection. It may naturally have several types of connection of the same type or of different types.

This connection device has a movable part 10 which, in the idle position according to FIG. 1*a*, does not leave a sufficient insertion space to insert a corresponding RJ45 plug. The user must then bring the movable part 10 into a position known as an insertion position or withdrawal position shown in FIG. 1*b*, in which the recess 13 provided in the movable part comes face-to-face with a recess provided in the housing (or frame) 5. Conductive elements located on the movable part can then be seen in the unoccupied space. The corresponding plug could then be inserted into the space. The contacts provided on the plug will come into contact with the conductive elements of the movable part which will then be in a position known as a position of operation that is not shown here in this angle of view.

Figure 2:
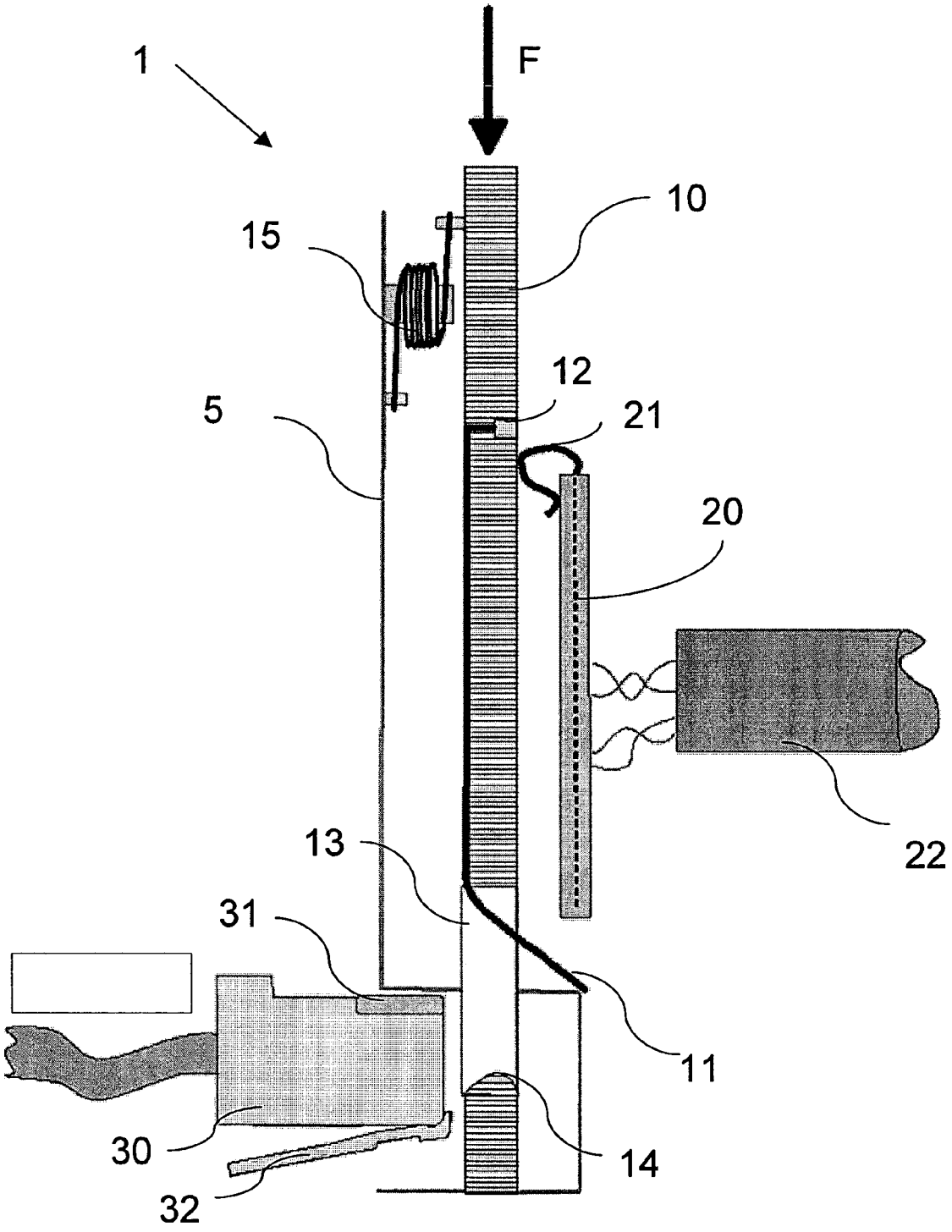
FIG. 2 shows a section along the plane A of the connection device according to a first embodiment when the movable part is in the idle position according to the invention.

FIG. 2 shows a view along the plane A of the connection device when the movable part is an idle position. The movable part is held in the idle position through a pullback force. This pullback force is obtained, for example, by a spring type of elastic means 15, located between the housing and the movable part.

In this figure, the spring is of the torsion spring type. Naturally, it may be any other type of spring within the scope of those skilled in the art. For simplicity's sake, this spring will not be shown in the other figures even though it is a spring that exists.

This FIG. 2 shows that the device has an electronic board 20 connected to a connection cable 22 of the communications network. This cable, which is for example of the UTP Cat 5 type (Unshielded Twisted Pair, category 5 type as specified in the ANSI/TIA/EIA/568A standard) conventionally used in Ethernet type networks, is used to convey both data and electrical energy to power the apparatuses that will be connected by means of the plug corresponding to the connection device.

Thus, the electronic board 20 has contacts 21 that serve to set up a connection with the conductive elements 12 of the movable part. These conductive elements are connected to other conductive elements 11 that enter the recess 13 of the movable part. These second conductive elements will come into contact with the contacts of the connection plug 30 when it is inserted into the device and when the movable part is in the operating position.

It can therefore be seen that the user cannot insert a plug or any other object into the connection device since the insertion space is partly covered with the movable part. Since the conductive elements 12 are not in contact with the contacts 21 of the electronic board, the movable part is not connected to the power supply from the network and the system is made safe for the user even in the event of the insertion of a metal element.

Figure 3:
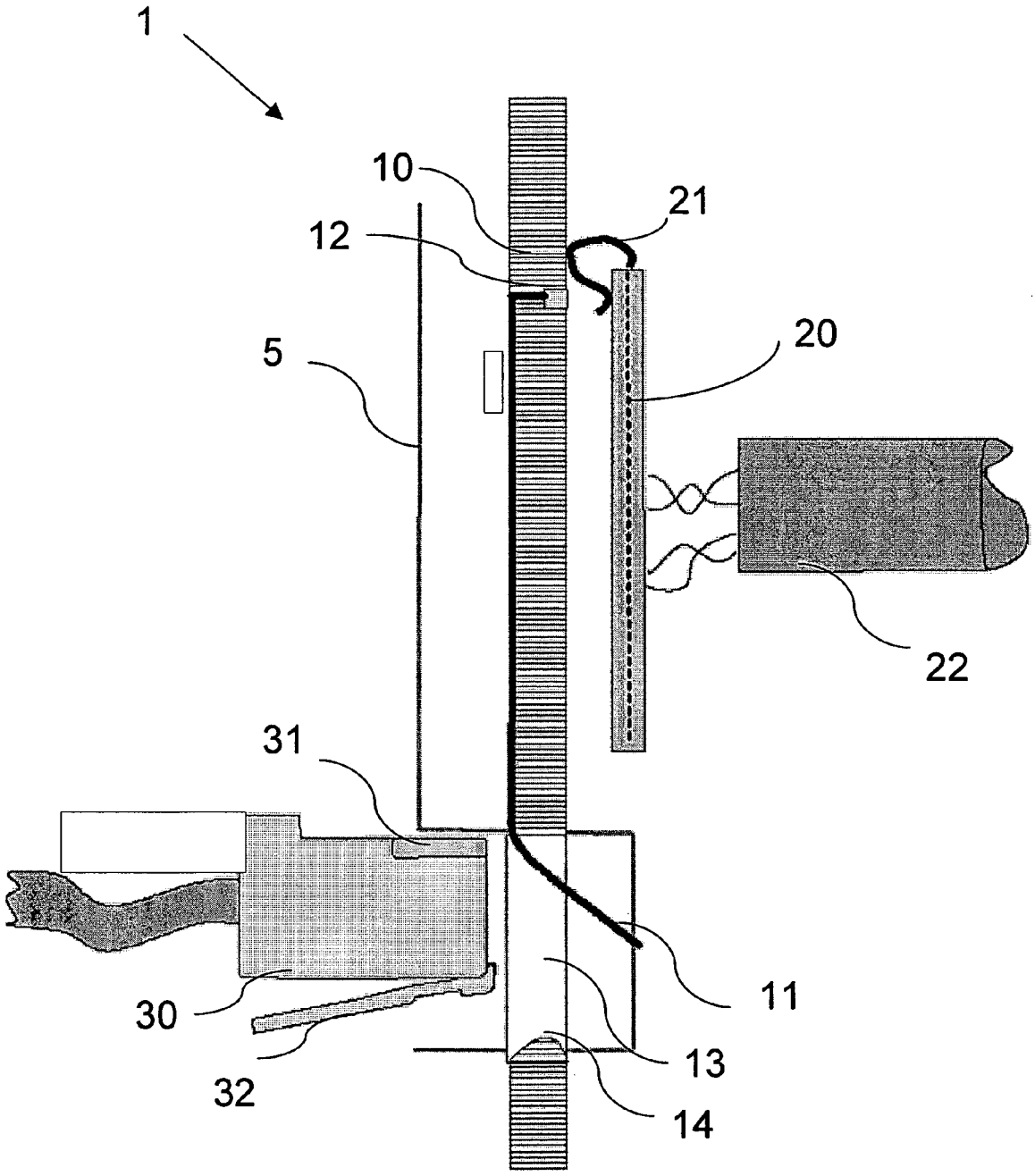
FIG. 3 shows a section along the plane A of the connection device according to a first embodiment when the movable part is in the position of insertion according to the invention.

To enable the insertion of the RJ45 plug 30 into the insertion device, the users should be able to free the insertion space by moving the movable part (in this embodiment by pressing on this part in the direction of the arrow F), so as to make it come into the position known as the insertion position shown in FIG. 3.

FIG. 3 therefore shows the insertion device when the movable part is in the insertion position. With the user having led the movable part so as to free the insertion space, the contacts 21 of the electronic board 20 are not always in contact with the conductive elements 12 of the movable part so much so that neither the electrical energy nor the pieces of data can reach the conductive elements 11. Thus the connection of the connection plug 30 can be made without prompting any arc effect. The contacts 31 of the plug 30 could come into contact with the conductive elements 11 without any data transfer or provision of power supply having yet taken place.

Figure 4:
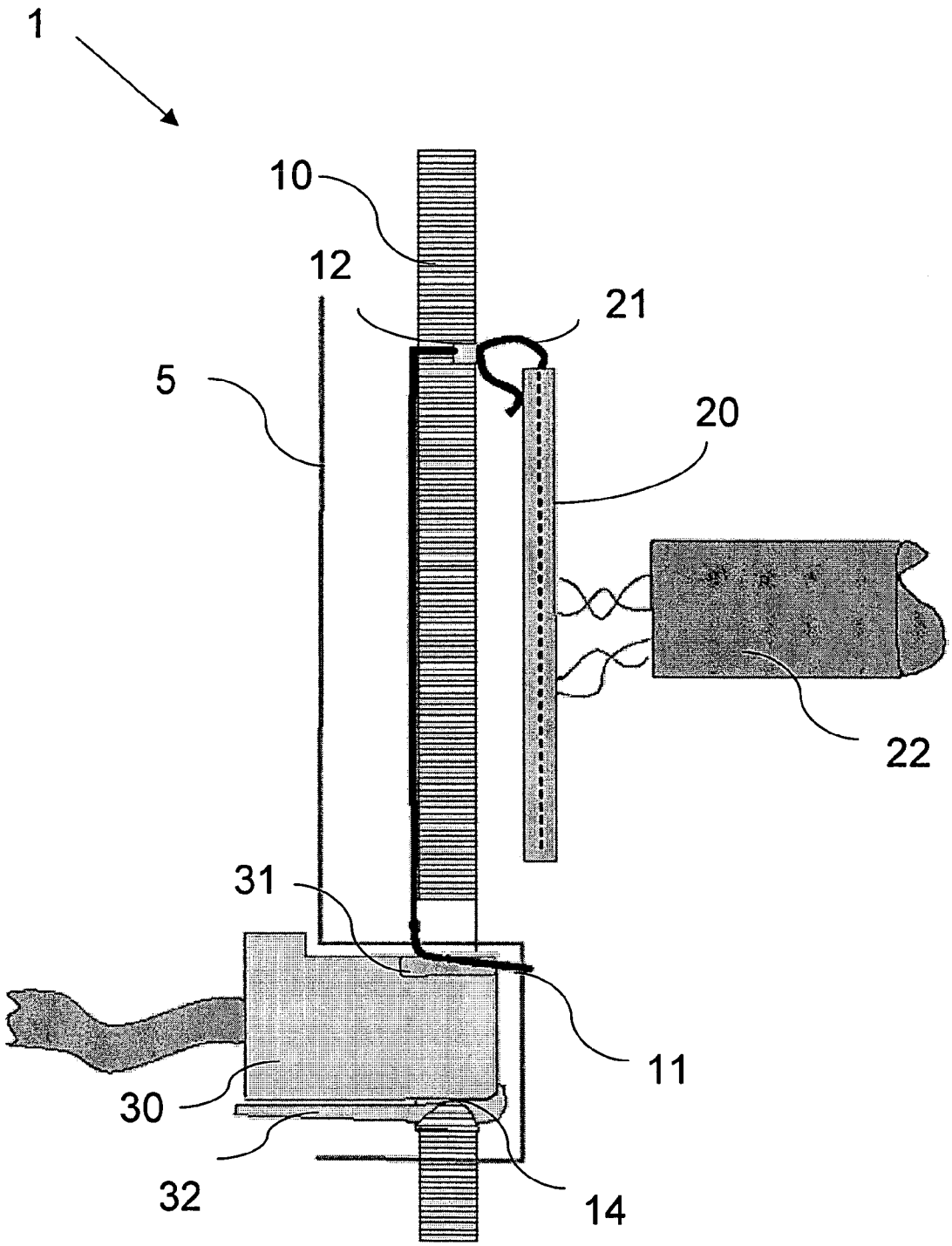
FIG. 4 shows a section along the plane A of the connection device according to a first embodiment when the movable part is in the position of operation according to the invention.

Once inserted according to FIG. 4, the plug is kept in this connection position through the movable part that has just got positioned in its operating position. The pullback force of the spring 15 maintains pressure between one of the surfaces of the contour 14 of the recess 13 on the surface 32 of the plug 30 that does not carry any contacts. Thus the plug cannot be easily disconnected. It can be noted that, in this position, the movable part brings its conductive elements 12 into a position facing the contacts 21 of the electronic board 20 so that the data exchanges and the transfer of energy can be done between the plug 30 and the network represented here by the connection cable 22.

An abrupt and unexpected disconnection cannot be made since, in this position, the pullback force of the movable part prevents the plug from being released. The user will have to make the movable part move again, in this case by pressing it from above so as to release the surface 14 from the surface 32 of the plug. The movable part will then reach its position of insertion and withdrawal as shown in FIG. 3. The disconnection of the conductive elements 12 and of the contacts 21 is thus achieved. The plug can then be removed and the arc effects will then be prevented.

FIGS. 5, 6, 7 and 8 show a connection device 2 in a second embodiment of the invention. Indeed, the connection device in this second embodiment still has a movable part but possesses additional conductive elements that enable a connection with the network either to enable the data exchange only or to enable both the data exchange and the transfer of energy.

Figure 5:
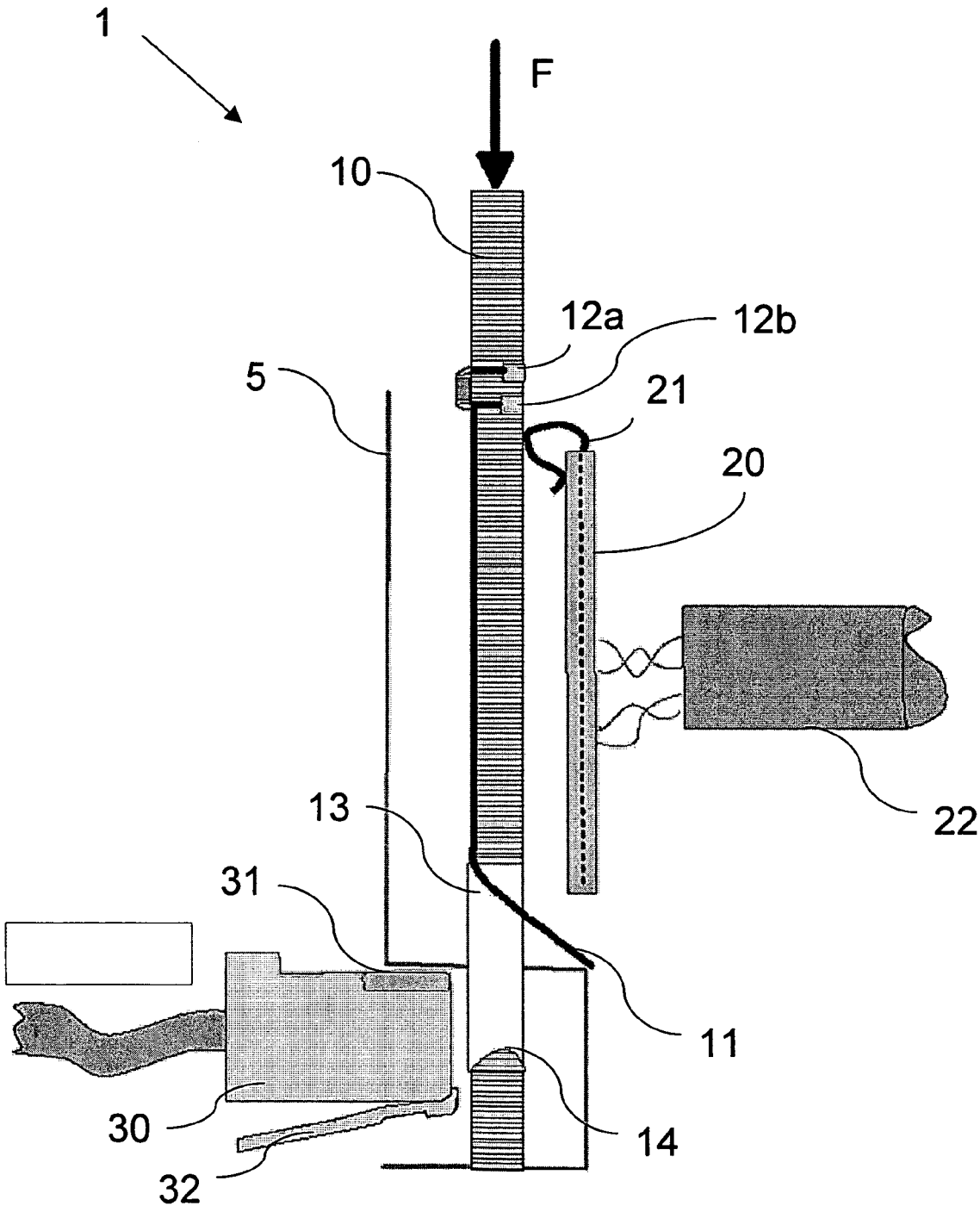
FIG. 5 shows a section along the plane A of the connection device according to a second embodiment when the movable part is in the idle position according to the invention.

Thus, FIG. 5 shows a connection device with the movable part in an idle position. In the same way as described in FIG. 2, the part is held in this position by a pullback force prompted by a spring identical to the one referenced 15 in FIG. 2. The movable part has first conductive elements 12*a* which, once in contact with the contacts 21 of the electronic board 20, enable only data exchange with the communications network.

The second conductive elements 12*b* can be used, when they are contact with the contacts 21 of the electronic board, both to exchange data and to transfer electrical energy. In the idle position, the contacts 21 of the electronic board come into contact neither with the conductive elements 12*a*, nor with the conductive elements 12*b*.

Figure 6:
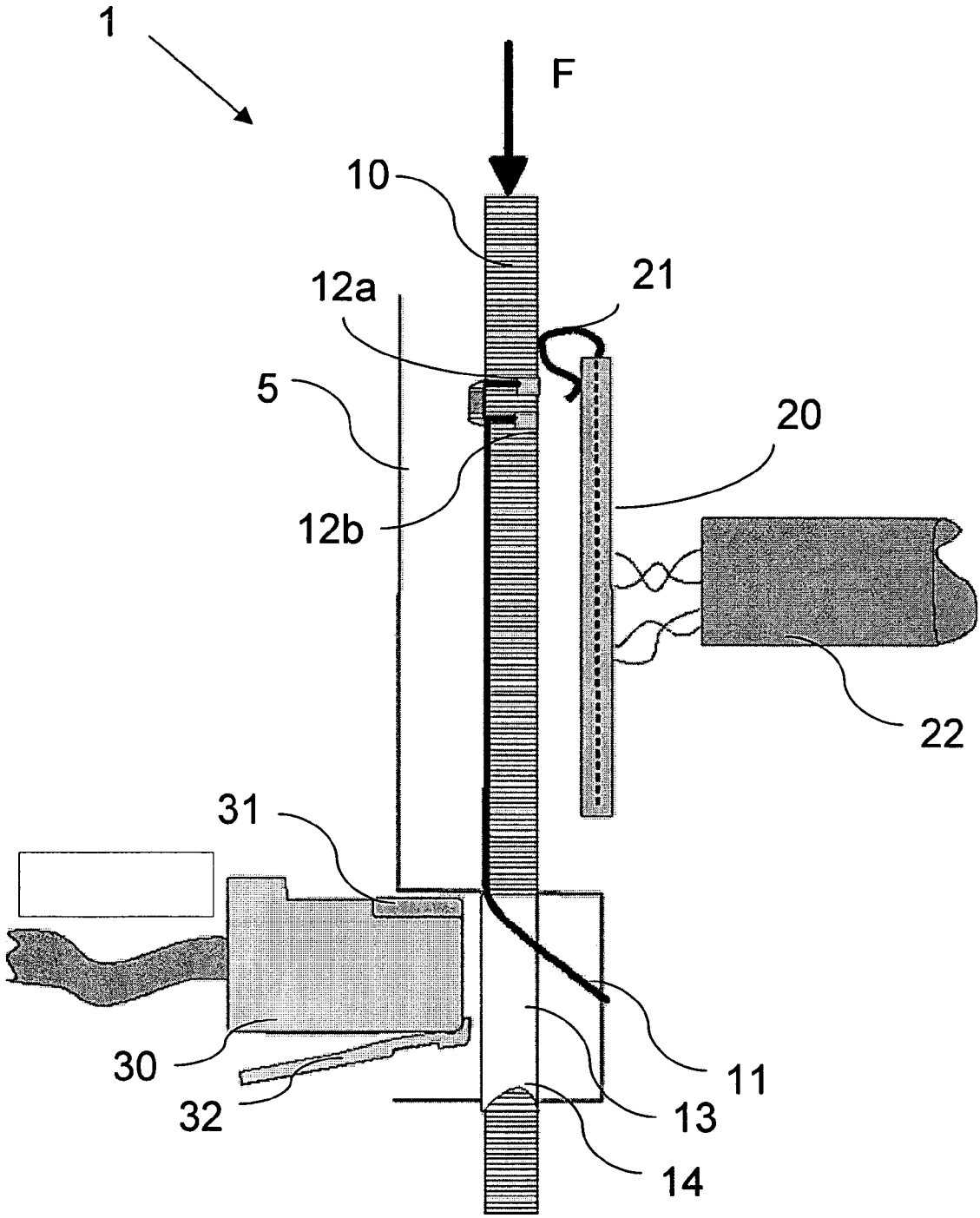
FIG. 6 shows a section along the plane A of the connection device according to a second embodiment when the movable part is in the position of insertion according to the invention.

To be able to insert a plug into the connection device, the user must make the movable part move (in the direction represented by the arrow F) so as to bring it into the position of insertion and withdrawal shown in FIG. 6.

FIG. 6 indeed gives a view, comparative to that of FIG. 3, of the connection device when the removable part is in the position of insertion or withdrawal. The insertion space is herein made free so as to enable the insertion of the corresponding connection plug, and the contacts with the electronic board are not made. The advantages here are similar to those of the first embodiment of FIG. 3.

Figure 7:
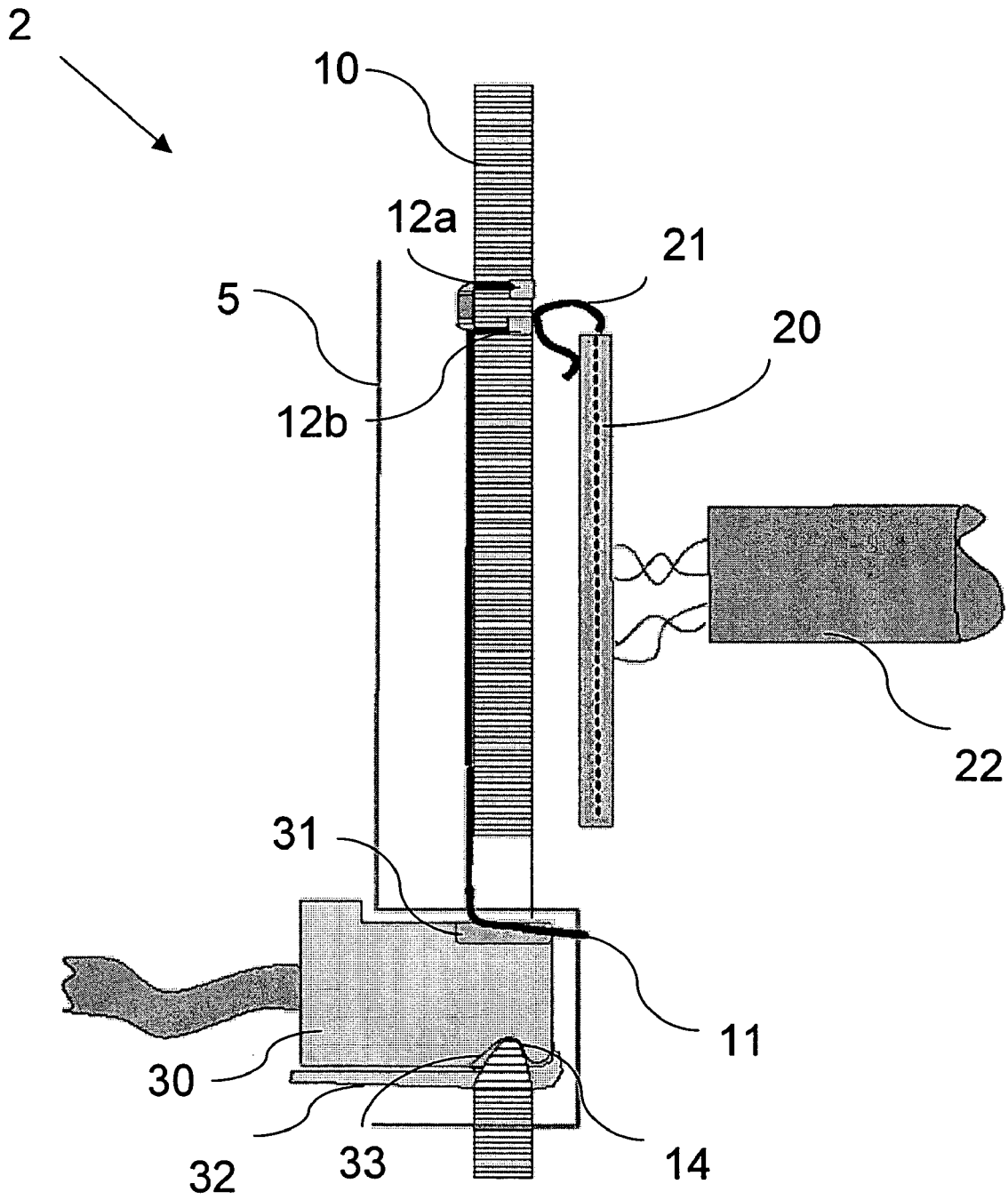
FIG. 7 shows a section along the plane A of the connection device according to a second embodiment when the movable part is in the position of operation and when the plug matches the device according to the invention.

FIG. 7 shows a connection device capable of receiving a connection plug with a particular shape. Indeed, the connection plug has a recess 33 that perfectly matches the protuberance 14 provided on the movable part. During the insertion of a plug of this kind, the movable part, by its pullback force, comes into contact with the surface of the plug comprising the recess 33. The protuberance 14 then gets nested into the recess. In this position, the contacts 21 of the electronic board come into contact with the conductive elements 12*b* of the movable part. This connection therefore enables both data exchange and a transfer of electrical energy. Thus, the apparatuses that can be supplied with power by means of their plugs can be provided with specific plugs, thus preventing errors of wrong connection. An apparatus with a specific plug will be perfectly adapted to the use of the connection device of the invention.

Figure 8:
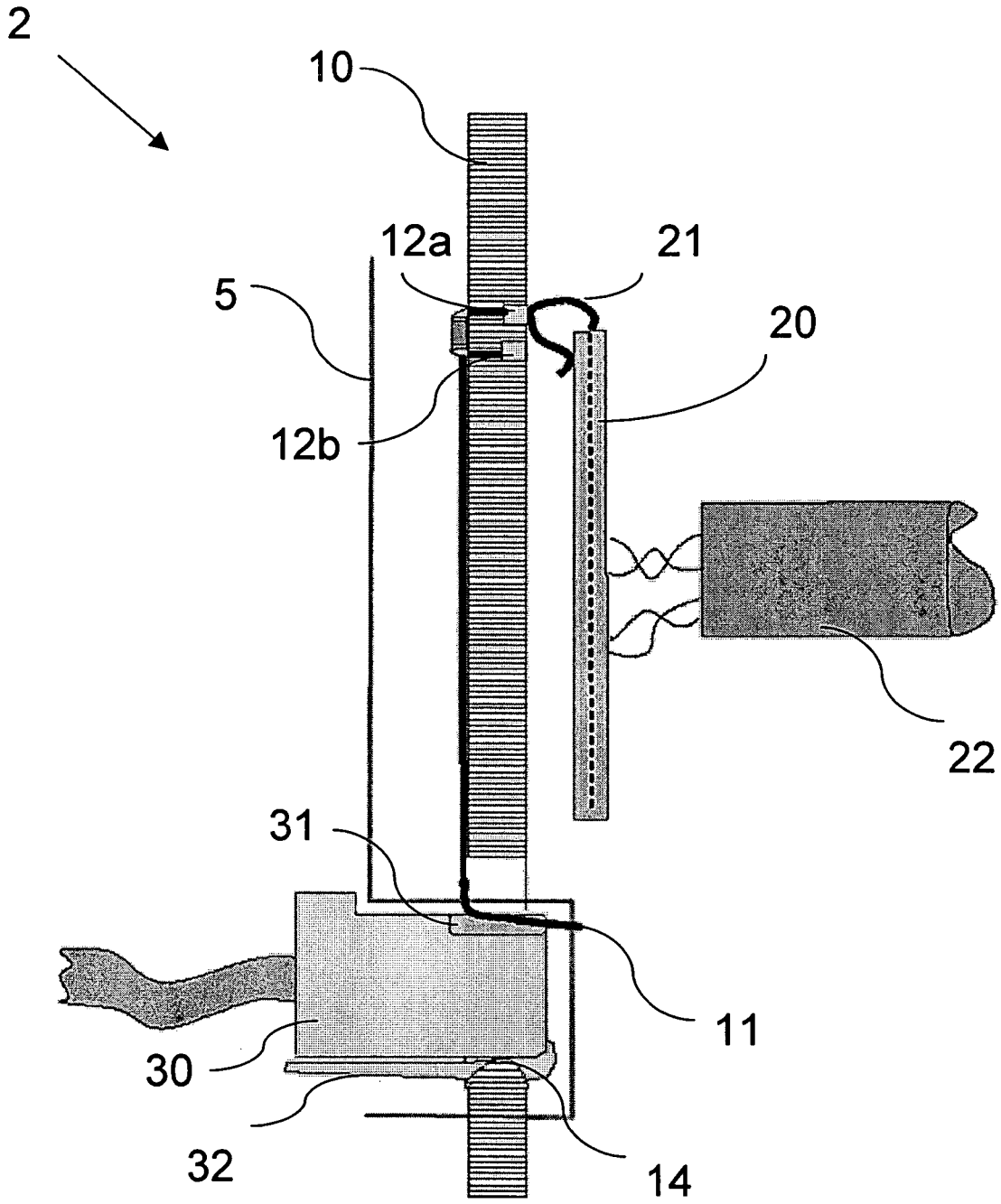
FIG. 8 shows a section along the plane A of the connection device according to a second embodiment when the movable part is in the position of operation and when the plug does not match the device according to the invention.

As can be seen in FIG. 8, it is possible to connect a standard RJ45 plug to the connection device. In this case, since the plug has no recess to match the protuberance of the movable part, this protuberance will come into contact with the surface of the plug having no electrical contacts. The movable part then reaches a position in which the contacts 21 will be connected to the conductive elements 12*a* so as to enable only data exchanges. Thus, if the apparatus with the standard RJ45 plug cannot take a power supply through its RJ45 plug, then a connection with the device of the invention will not damage its electronic interface.

The disconnection in this embodiment is made in the same way as in the first embodiment. The user must make the movable part move so as to bring it into the position of insertion or withdrawal shown in FIG. 6.

In a preferred embodiment, the protuberance has a rounded shape, so as to make disconnection possible if the user pulls hard on the plug or on the cable of the plug. Indeed, if the plug is far too strongly entrenched in its operating position, any substantial disconnection force could tear out the connection device and damage it. The protuberance with a rounded shape averts this problem if the tearing strength is greater than the pullback force of the movable part.

Figure 9:
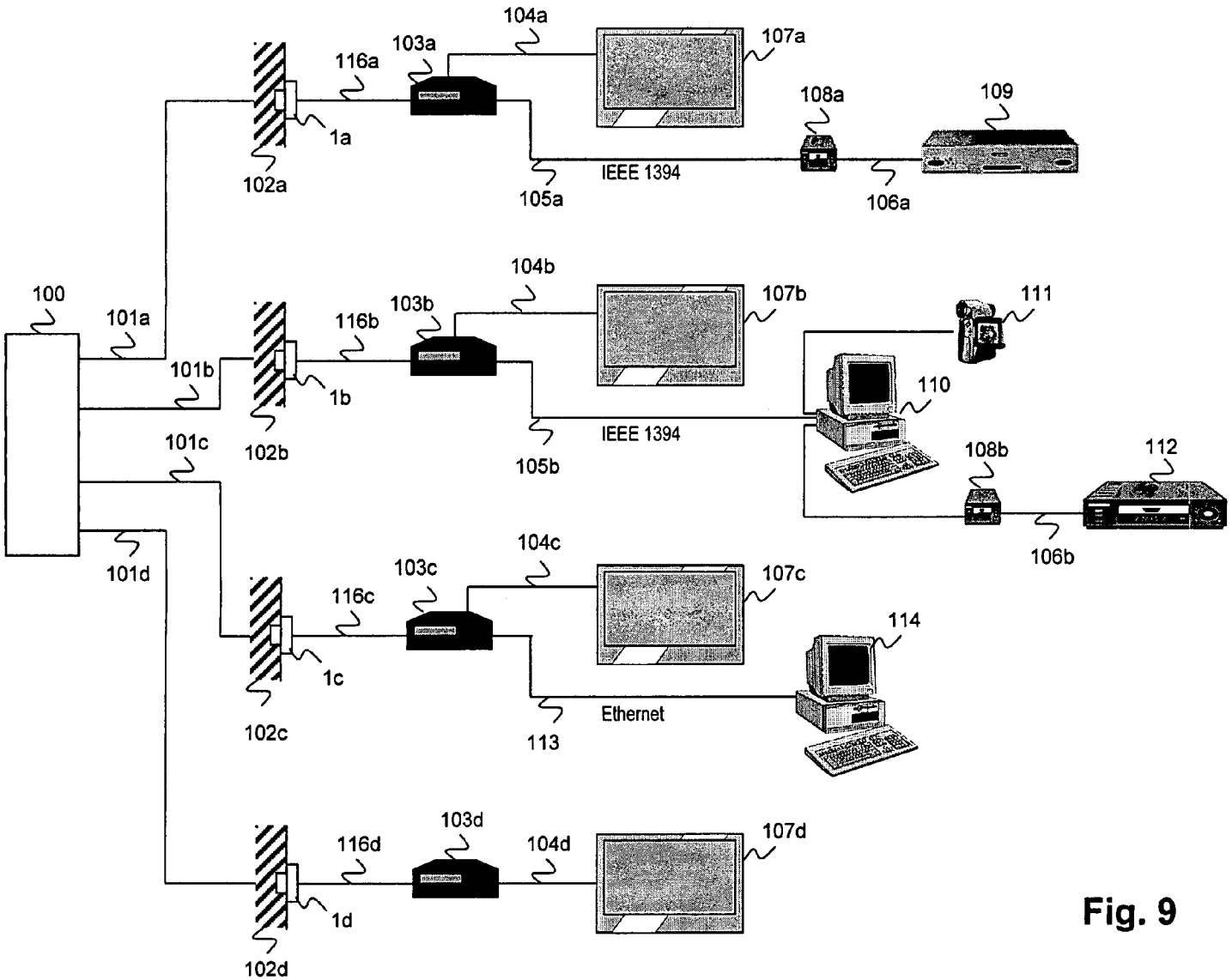
FIG. 9 shows a home communications network in which it is planned to have the connection device according to the invention.

FIG. 9 shows a home multimedia communications network in which it is advantageously possible to plan for the connection device according to the invention.

Thus multimedia communications network interconnects apparatuses such as television sets referenced 107*a*, 107*b*, 107*c* and 107*d*, DVD player type readers referenced 109, a video-cassette recorder referenced 112, computer type apparatuses referenced 110 and 114, as well as a digital camcorder referenced 111.

It is provided that the connection devices 1*a*, 1*b*, 1*c* and 1*d* according to the invention will be laid out in partition walls 102*a*, 102*b*, 102*c* and 102*d* of the rooms of a dwelling.

This network has multimedia interface apparatuses referenced 103*a*, 103*b*, 103*c* and 103*d*. These multimedia interface apparatuses are respectively connected through links 116*a*, 116*b*, 116*c* and 116*d* to the connection devices 1*a*, 1*b*, 1*c* and 1*d*.

The connection devices are connected to a central switching unit 100 preferably placed next to the electrical power supply switchboard through links referenced 101*a*, 101*b*, 101*c* and 101*d*. These links are for example of the UTP Cat 5 type (Unshielded Twisted Pair, category 5 type as specified in the ANSI/TIA/568A standard) classically used in Ethernet type networks.

Each of the multimedia interface apparatuses comprises at least connections of the Ethernet and IEEE1394 type and one analog video output. All the information obtained by these connection means is distributed to the other remote multimedia interface apparatuses through the central switching unit 100 and the links connecting this unit to the different multimedia interface apparatuses. The central switching unit comprises a management module responsible for routing the digital type data packets in the communications network, as a function of the path information that they contain. This module enables the performance of centralized data management in the communications network.

Furthermore, the central switching unit also provides for a transfer of electrical energy through the links 101*a*, 101*b*, 101*c* and 101*d*, to supply power to the multimedia interface apparatuses 103*a*, 103*b*, 103*c* and 103*d* through the connection devices 1*a*, 1*b*, 1*c* and 1*d*. The voltage available at the input of the multimedia interface apparatuses is in the range of 48V for example.

The television set 107*a* is connected by means of an analog video link 104*a* to the multimedia interface apparatus 103*a*. According to one variant, the link 104*a* may be compliant with the IEEE1394 standard and the television set then has an IEEE1394 board. Similarly, the television sets 107*b*, 107*c* and 107*d* are respectively connected to the multimedia interface apparatuses 130*b*, 103*c* and 103*d* by means of analog video links 104*b*, 104*c* and 104*d*.

The DVD player referenced 109 is connected by means of an analog link 106*a* to an analog-digital converter referenced 108*a*. This converter is itself connected by means of a digital link 105*a* compliant with the IEEE 1394 standard to the multimedia interface apparatus 103*a*. This converter converts the analog video information generated by the DVD player into a format compatible with the IEEE1394 standard.

The computer 110, the camcorder 111 and the analog-digital converter 108*b* are connected to one another and to the multimedia interface apparatus 103*b* by means of a digital link 105*b* compliant with the IEEE 1394 standard. The analog-digital converter 108*b* is itself connected to the analog videocassette recorder 112 by means of the link 106*b*.

The computer referenced 114 is connected by means of an Ethernet type link referenced 113 to the multimedia interface equipment 103*c*.

In particular, the connection devices 1*a*, 1*b*, 1*c* and 1*d* are particularly suited to use in such a network. Indeed, the multimedia interface apparatuses are powered by the central module 100. The electrical energy must therefore flow through the connection devices 1*a*, 1*b*, 1*c* and 1*d*.

To make the devices safe when the interface apparatuses are not connected and to avert arc effects during abrupt and unexpected connections and disconnections of these interface apparatuses, it is judicious to provide for connection devices according to the invention.

In a particular embodiment, the connection means of the cables 116*a*, 116*b*, 116*c* and 116*d* have a specific shape in accordance with the invention so as to enable the transfer of electric energy. This type of connection can then be used to identify the fact that the interface apparatus is capable of receiving electrical energy and is adapted to the communications network.

With a connection device according to the second embodiment of the invention, the connection of a classic Ethernet apparatus unable to take an electrical power supply through its Ethernet link would not be damaged. Indeed, the non-matching shape of its connection means would bring the connection device into the configuration shown in FIG. 8 and the transfer of electrical energy would then not be possible.

What is claimed is:

1. A connection device that is capable of receiving a corresponding connection plug and comprises a housing, an electronic board connected to at least one cable of a communications network capable of conveying data as well as electrical energy, wherein this device comprises a movable part between the housing and the electronic board comprising conductive elements used to make an electrical link between the plug and the electronic board, the movable part having at least three positions, a first position known as a position of insertion or withdrawal of the plug, in which the electrical link cannot be made, a second position known as a position of operation in which an inserted plug is held by the movable part and the electrical link can be made, and a third position, known as an idle position, in which the insertion of the connection plug is not possible.

2. A connection device according to claim 1, wherein the movable pad, is held in the third position when a connection plug is not inserted, by a pullback force.

3. A connection device according to claim 1, wherein the movable part comprises a recess enabling insertion of a plug and a protuberance that comes into contact with a surface of the plug that has no electrical contacts so as to maintain it in the inserted position in the device by a pullback force.

4. A device according to claim 2 or 3, wherein the pullback force is obtained by an elastic means provided between the housing and the movable part.

5. A device according to claim 1, wherein the movable part of the device comprises at least two conductive elements, one enabling a link between the connection plug and the electronic board for data exchange and a transfer of electrical energy from the network and the other conductive element enabling only a data exchange.

6. A device according to claim 5, wherein the movable part comprises a recess enabling insertion of a plug and a protuberance that comes into contact with a surface of matching shape of a connection plug so that, when a plug with a matching shape is inserted, the movable part takes the second position.

7. A device according to claim 6 wherein, when a connection plug having no surface of matching shape is inserted, the movable part takes a fourth position in which the electrical link is not possible whereas the link for the exchange of data is possible.

8. A device according to one of the claims 3, 6 or 7, wherein the protuberance comprises a rounded surface.

* * * * *

UNITED STATES PATENT AND TRADEMARK OFFICE

CERTIFICATE OF CORRECTION

PATENT NO. : 7,144,261 B2
APPLICATION NO. : 11/126207
DATED : December 5, 2006
INVENTOR(S) : Merlet It is certified that error appears in the above-identified patent and that said Letters Patent is hereby corrected as shown below:

COLUMN 7:
Line 41, "130*b*," should read -- 103*b*, --.

COLUMN 8:
Line 36 claim 2, "pad, is" should read -- part is --; and
Line 58 claim 7, "claim 6" should read -- claim 6, --.

Signed and Sealed this

Eighteenth Day of March, 2008

JON W. DUDAS
*Director of the United States Patent and Trademark Office*